US006988297B2

(12) United States Patent
Willard et al.

(10) Patent No.: US 6,988,297 B2
(45) Date of Patent: Jan. 24, 2006

(54) SECURITY COVER FOR PASSIVE RESTRAINT BUCKLE

(76) Inventors: Troy M. Willard, 2328 NW. 39th St., Topeka, KS (US) 66618; Daniel R. Willard, 8517 Rosehill, Lenexa, KS (US) 66215; Wade D. Willard, 16220 W. 125 Ter., Olathe, KS (US) 66062

( * ) Notice: Subject to any disclaimer, the term of this patent is extended or adjusted under 35 U.S.C. 154(b) by 67 days.

(21) Appl. No.: 10/837,919

(22) Filed: May 3, 2004

(65) Prior Publication Data

US 2005/0241123 A1 Nov. 3, 2005

(51) Int. Cl.
*A44B 11/26* (2006.01)

(52) U.S. Cl. ..... 24/633

(58) Field of Classification Search ..... None
See application file for complete search history.

(56) References Cited

U.S. PATENT DOCUMENTS 4,502,194 A 3/1985 Morris et al.
4,624,033 A * 11/1986 Orton ..... 24/633
4,674,303 A * 6/1987 Salcone, II ..... 24/633
4,987,662 A * 1/1991 Haffey et al. ..... 24/633
5,307,544 A * 5/1994 Quarberg et al. ..... 24/633
6,041,480 A * 3/2000 White ..... 24/633
6,332,252 B1 * 12/2001 Powers ..... 24/633
6,431,652 B1 * 8/2002 Kennedy ..... 297/464

OTHER PUBLICATIONS

Figs 1 & 2 filed with application.

* cited by examiner

*Primary Examiner*—Robert J. Sandy
(74) *Attorney, Agent, or Firm*—Mark E. Brown

(57) ABSTRACT

A security cover is provided for a belt-type passive restraint system including a buckle with a tab and a receiver. The cover includes a slot for receiving the buckle tab and an enclosure for receiving the buckle receiver. An optional retainer assembly can be provided for retaining the cover on the buckle receiver or the belt. The buckle is released by inserting a key through a corresponding keyhole formed in a tab end of the cover.

20 Claims, 12 Drawing Sheets

SECURITY COVER FOR PASSIVE RESTRAINT BUCKLE

BACKGROUND OF THE INVENTION

1. Field of the Invention

The present invention relates generally to vehicle safety equipment, and in particular to a security cover for seat belt buckles.

2. Description of the Related Art

Passive restraints for occupants are standard safety equipment in many vehicles. They generally include seatbelts, shoulder harnesses and other equipment, which restrain the occupants for protection from "secondary" collisions. Various combinations and configurations of seat belts and shoulder harnesses have been developed, generally with the objectives of providing safety, comfort and convenience to the occupants. For example, both separate and combined seatbelts and shoulder harnesses have been provided in vehicles. Such belt-type passive restraints generally include buckles comprising tabs and receivers, which are selectively engaged by the occupants when securing and releasing same upon entering and exiting the vehicle.

Vehicles are often used for transporting individuals with special security considerations. Law enforcement officers are often required to transport individuals in custody under security conditions requiring restraint in order to prevent escape. Incidents have arisen wherein criminal suspects, convicted inmates and accomplices have involved law enforcement officers in serious and even deadly altercations in the course of being transferred between detention facilities, courthouses, etc.

It is therefore desirable to provide vehicle operators and others who are responsible for the safety and security of such passengers with locking restraints. Criminal suspects and inmates are commonly handcuffed during such procedures, but nevertheless pose serious hazards of escape and flight while in transit. Another criteria for such equipment is portability from vehicle-to-vehicle and adaptability to a wide range of vehicles. For example, in connection with extradition and other proceedings requiring travel to other jurisdictions, law enforcement officers are often required to use locally-available vehicles. A compact, universally-adaptable, portable restraint locking system would be highly beneficial to officers in connection with discharging such duties.

However, heretofore there has not been available a passive restraint locking system with the advantages and features of the present invention.

SUMMARY OF THE INVENTION

In the practice of the present invention, a security cover is provided for a belt-type passive restraint system including a buckle with a tab selectively received in a tab receiver. The tab receiver includes a release button for releasing the tab whereby the passive restraint system is opened. The security cover includes a slot for receiving the tab and a keyhole located thereover for passing a key to the release button for releasing same. An optional restraint assembly can be provided for retaining the security cover on the belt receiver.

DETAILED DESCRIPTION OF THE PREFERRED EMBODIMENTS

I. Introduction and Environment

Figure 2:
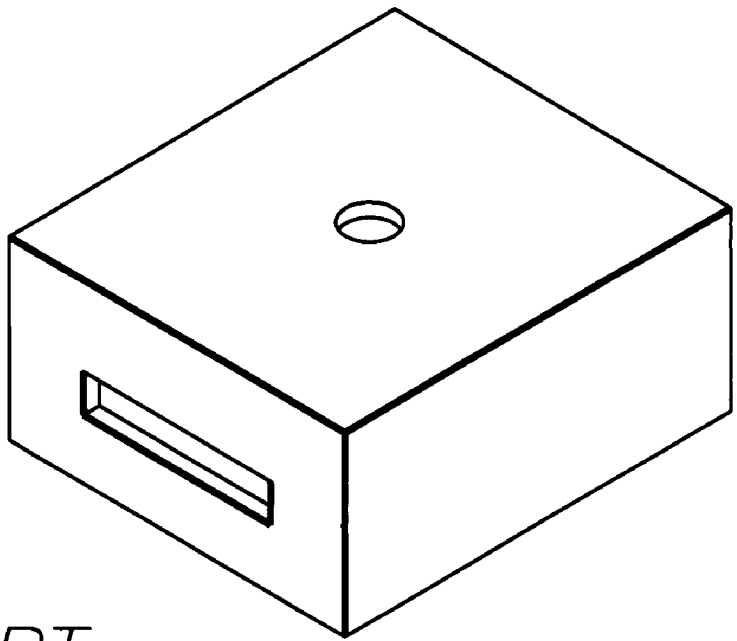
FIG. 2 PRIOR ART
FIGS. 1 and 2 show a prior art security cover for the buckle of a belt-type passive restraint system.
Figure 1:
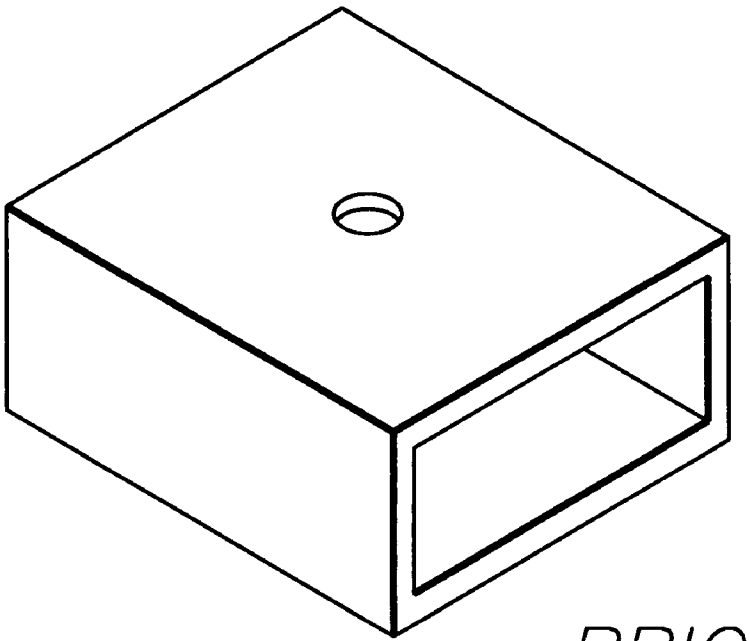

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning.

Referring to the drawings in more detail, the reference numeral 2 generally designates a security cover embodying the present invention. Without limitation on the generality of useful applications of the security cover 2, it is shown with a belt-type passive restraint system 4 including a buckle receiver 6 mounted on the end of a belt 8, which forms a loop 10. The receiver 6 includes a release button 12, which can be pressed to release a buckle tab (not shown) from the receiver 6 for releasing the passive restraint system 4. The passive restraint system 4 can comprise a seatbelt, a shoulder harness, a combined seatbelt-and-shoulder harness or some other type of system with a buckle. The buckle receiver 6 can also be mounted on a semi-rigid cable or attached directly to the body of a vehicle. Moreover, other configurations of passive restraint systems, buckles and release buttons can be accommodated by different aspects of the present invention.

II. Security Cover Preferred Embodiments

Figures 3, 3A:
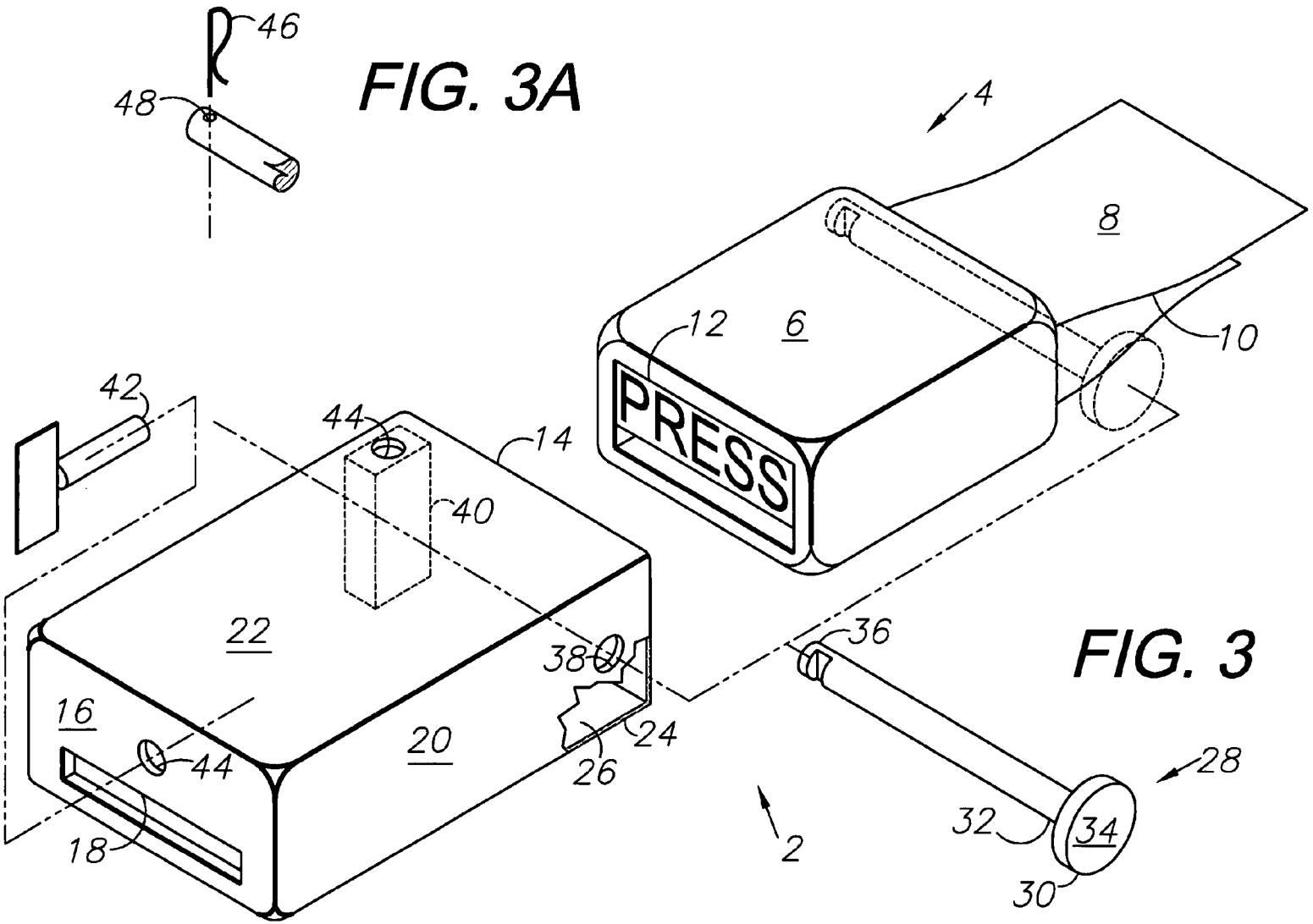
FIG. 3 is a prospective view of a security cover for the buckle of a belt-type passive restraint system, including a retaining pin.
FIG. 3A is a perspective view of a modified retaining pin for the security cover.

FIG. 3 shows the security cover 2, which includes an open receiver end 14, a tab end 16 with a tab slot 18 and a keyhole 44, opposite side panels 20, a top panel 22 and a bottom panel 24, which collectively define an enclosure 26. A retainer assembly 28 includes a retaining pin 30 with a proximate end 32 mounting an enlarged head 34 and a notched distal end 36. The retaining pin 30 is adapted for passing through a retaining pin aperture 38 and one of the side panels 20 and into a retaining pin lock 40 mounted in the enclosure 26 adjacent to the receiver end 14. A retainer keyhole is provided in the top panel 22 for actuating the retaining pin lock 40.

In operation, the buckle receiver 6 is inserted into the cover enclosure 26 and the retaining pin 30 is inserted through the aperture 38, the belt loop 10 and into the retaining pin lock 40. Alternatively, the retaining pin 30 can be positioned over or under the belt loop 10 and retain the buckle receiver 6 within the cover enclosure 26. The seatbelt or shoulder harness tab is inserted through the slot 18 to secure the restraint system 4. Releasing the restraint system 4 is accomplished by inserting a key 42 through a keyhole 44 formed in the cover tab end 16 above the slot 18.

FIG. 3A shows a flexible clip 46 adapted for insertion through a flexible clip aperture 48 whereby the retaining pin 30 can be releasably secured in the cover 2 and through the belt loop 10, as an alternative to the retaining pin lock 40.

Figure 4:
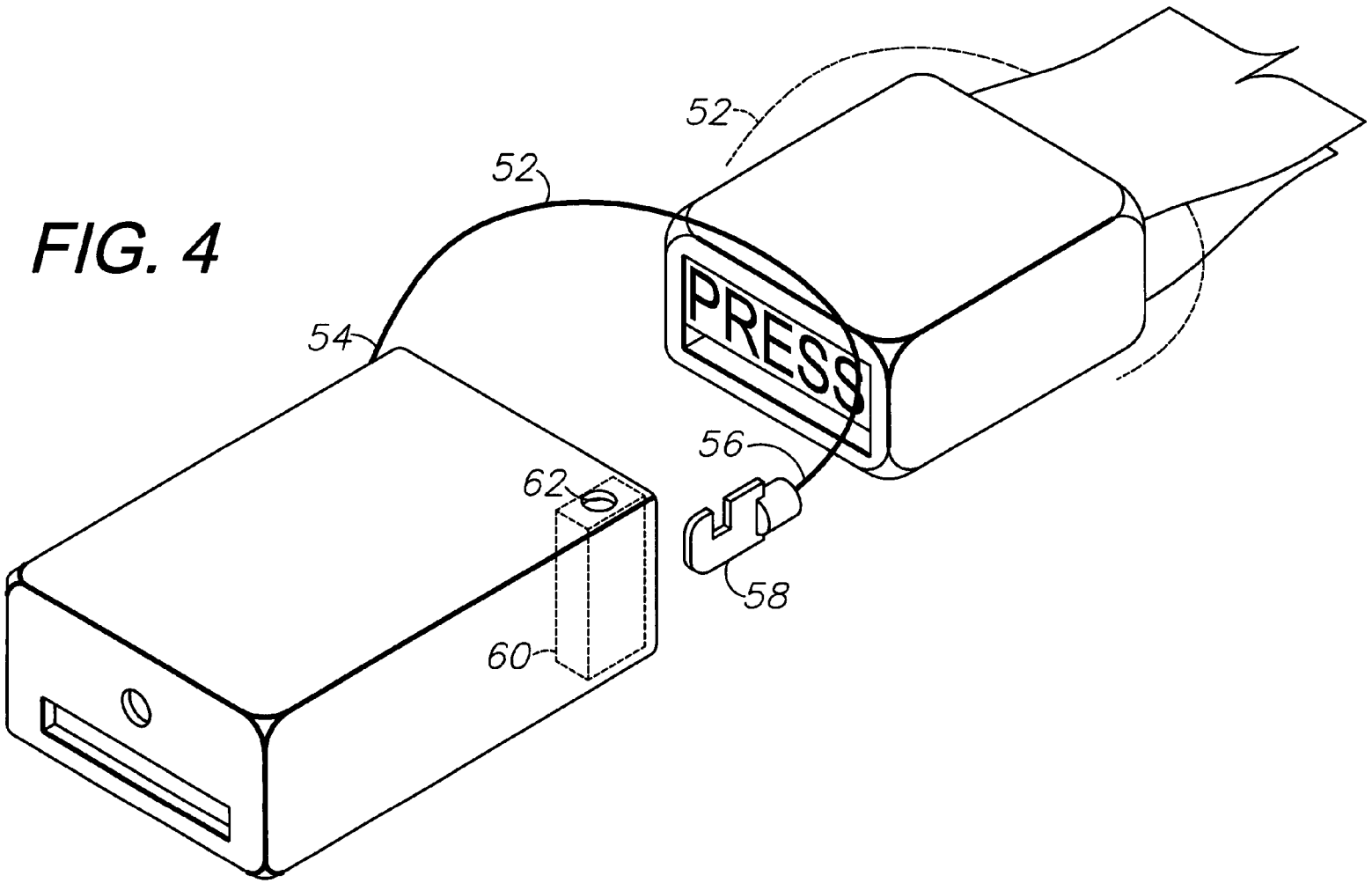
FIG. 4 is a perspective view of a security cover comprising another aspect of the invention, including a retaining cable.
Figure 5:
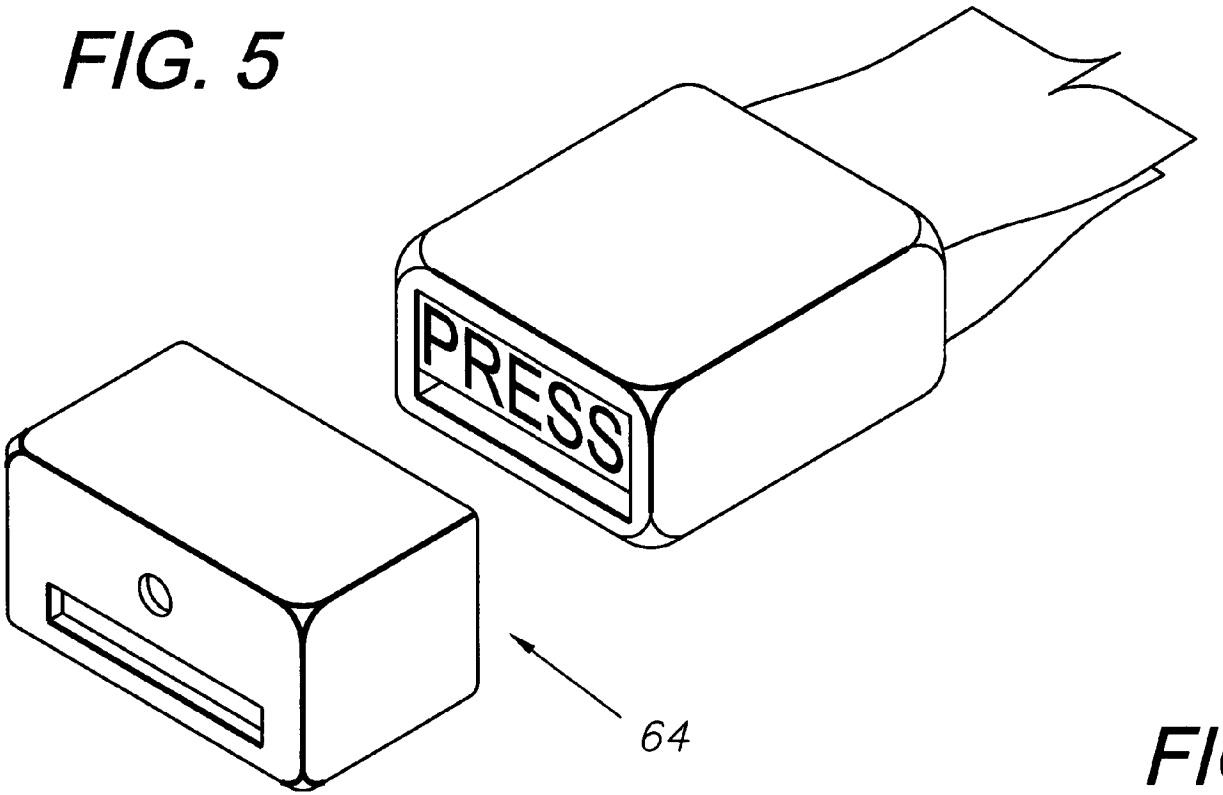
FIG. 5 is a perspective view of a security cover comprising another aspect of the invention.
Figure 5A:
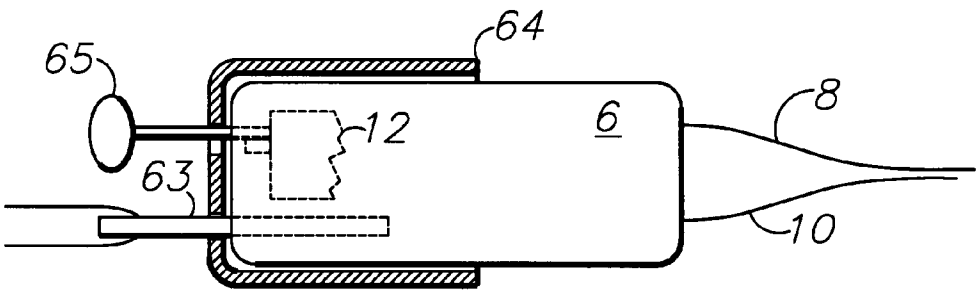
FIG. 5A is a longitudinal, cross-sectional view of the security cover shown in FIG. 5, installed on a seatbelt and shoulder harness buckle.
Figure 6:
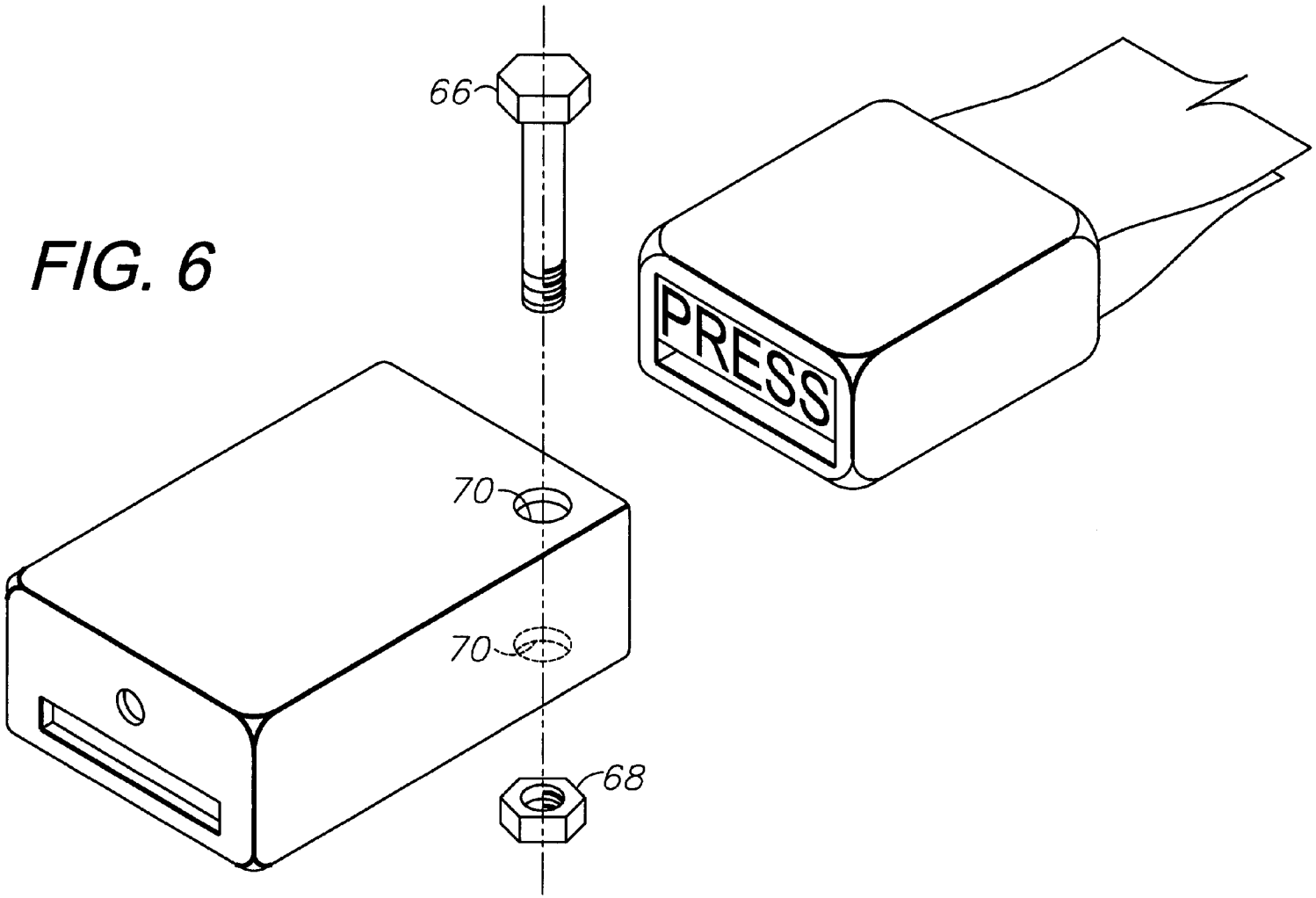
FIG. 6 is a perspective view of a security cover comprising another aspect of the invention, including a retaining bolt and nut.

FIG. 4 shows another aspect of the invention with a retaining cable 52 attached at a proximate end 54 to a respective cover side panel 20. A cable distal end 56 mounts a hook 58 selectively receivable and a cable lock 60 actuated through a lock keyhole 62. FIG. 5 shows another aspect of the invention with an unsecured cover 64, adapted for placement over the buckle receiver 6 and retained in place by the buckle tab. FIG. 5A shows the cover 64 positioned on the buckle receiver 6 with a buckle tab 63 locked therein. A key 65 is inserted through a keyhole 67 and is pushing the release button 12 whereby the tab 63 will be released from the buckle receiver 6. FIG. 6 shows another aspect of the invention with a retaining bolt 66 threadably mounting a retaining nut 68 and adapted for placement through aligned apertures 70 formed in the top and bottom panels 22, 24. The retaining bolt 66 is adapted for selectively retaining buckle receiver 6 within the cover enclosure 26.

Figure 7:
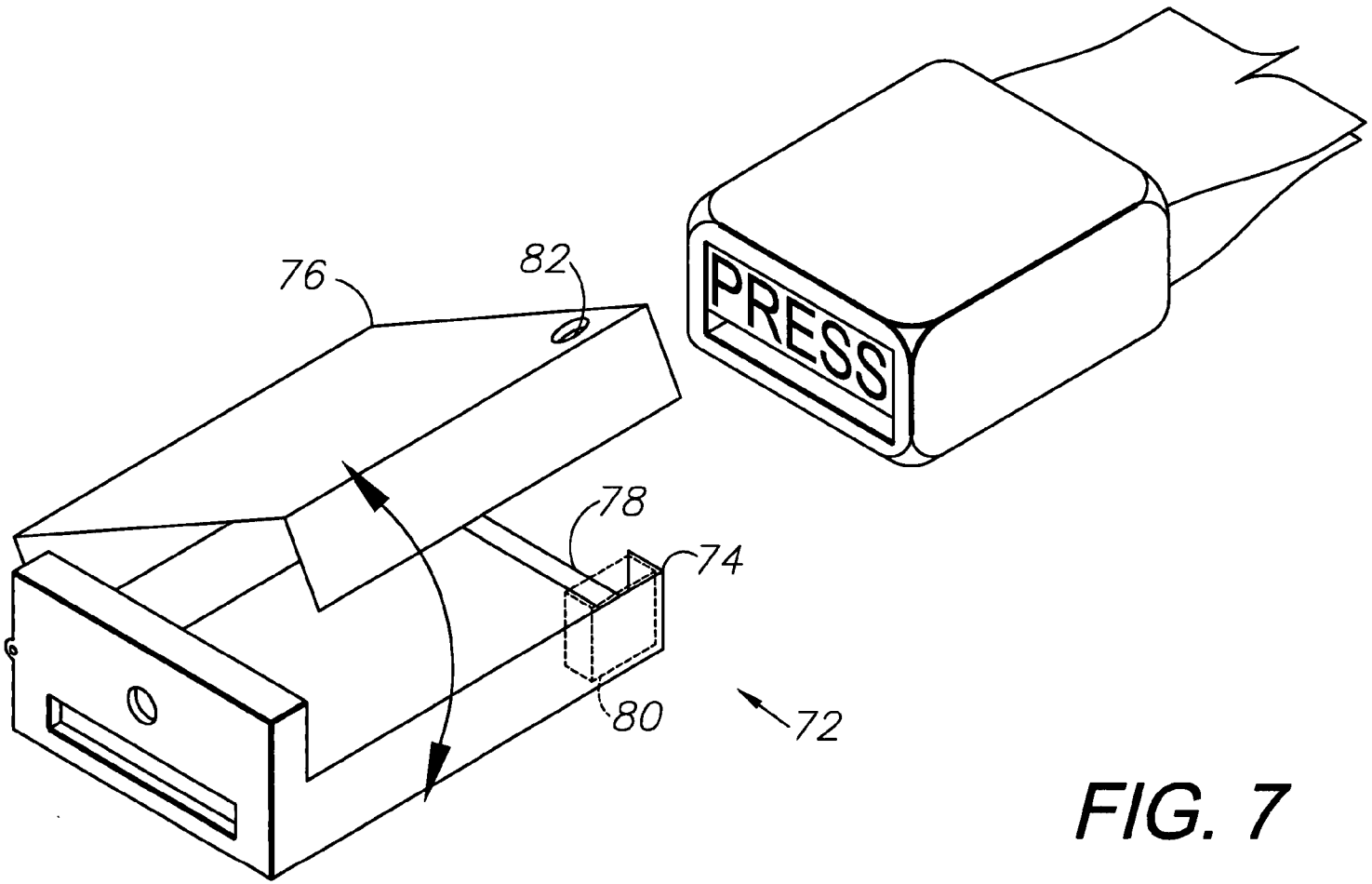
FIG. 7 is a perspective view of a security cover comprising another aspect of the invention, with a hinged lid.
Figure 8:
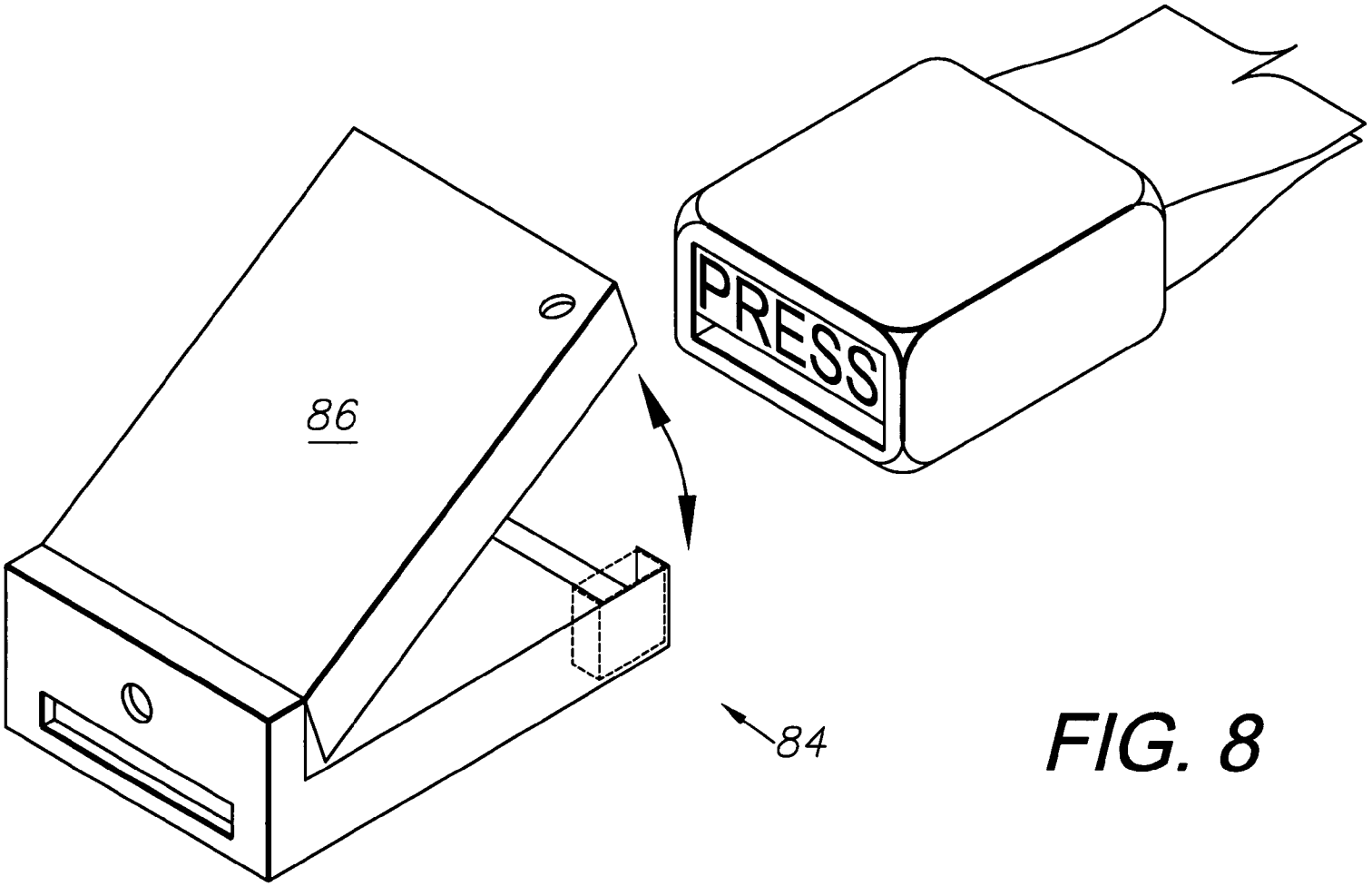
FIG. 8 is a perspective view of a security cover comprising another aspect of the invention, with another type of hinged lid.

FIG. 7 shows another aspect of the invention with a modified cover including a base 74 hingedly mounting a lid 76 and collectively forming a belt opening 78 adapted for selectively capturing the belt 8. The lid 76 can be selectively locked in a closed position by a suitable lid lock 80 adapted for actuation through a lid keyhole 82. FIG. 8 shows a cover 84 comprising another aspect of the invention with a modified lid 86.

Figure 9:
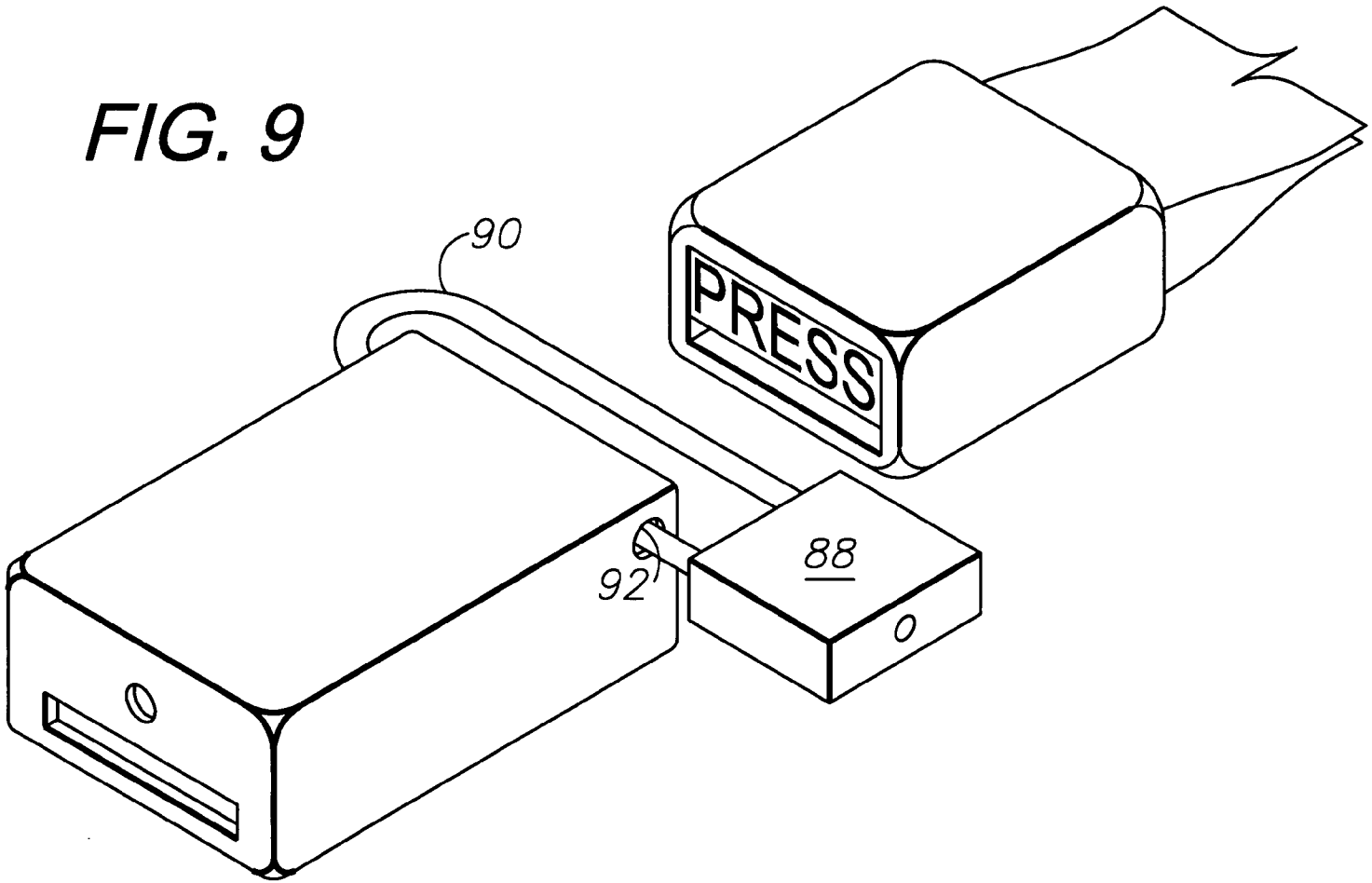
FIG. 9 is a perspective view of a security cover comprising another aspect of the invention, with a padlock.
Figure 10:
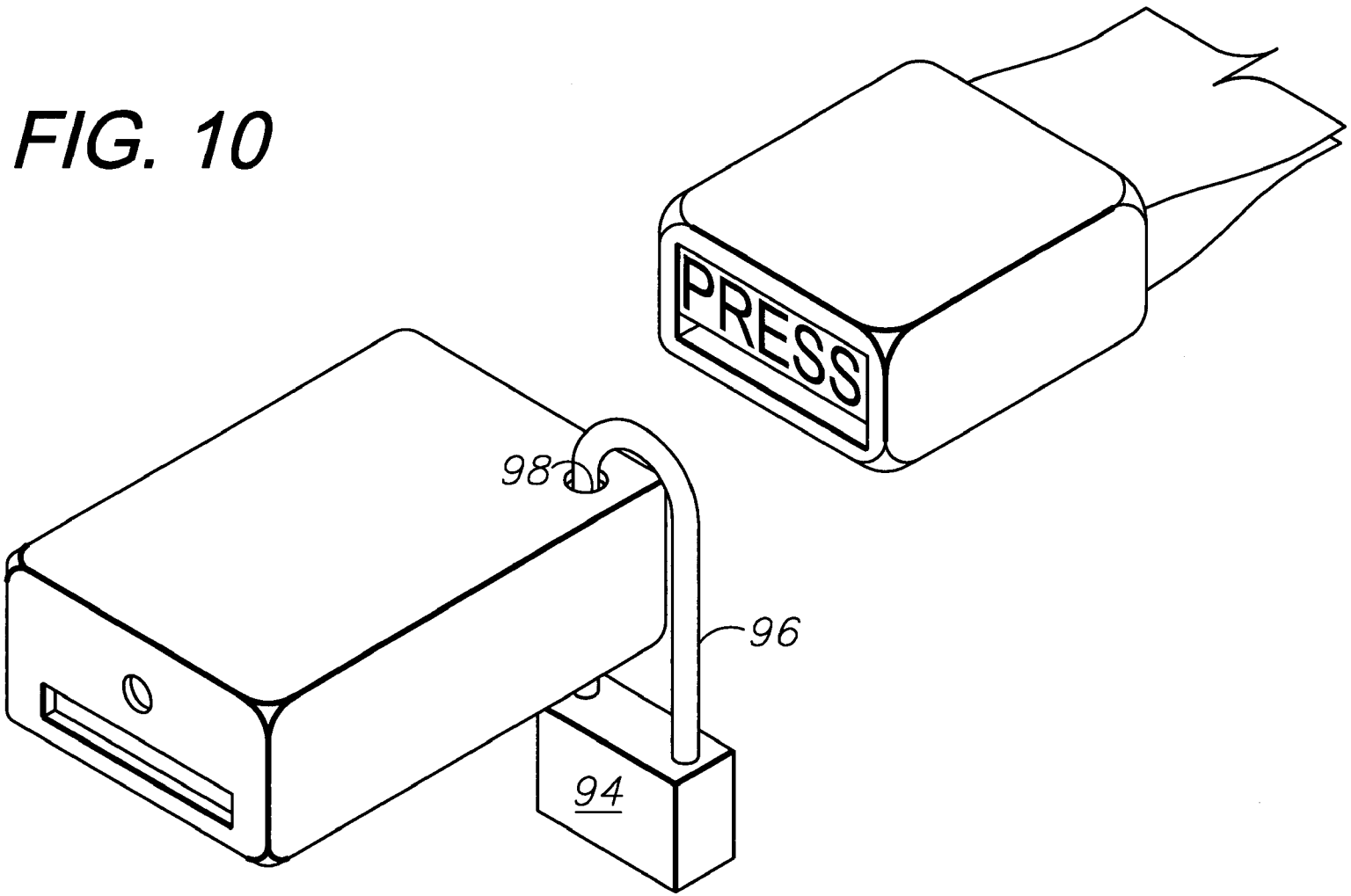
FIG. 10 is a perspective view of a security cover comprising another aspect of the invention, with another type of padlock.

FIG. 9 shows another aspect of the invention including a padlock 88 with a hasp 90 extending through aligned hasp apertures 92 in the cover side panels 20. FIG. 10 shows another aspect of the invention including a padlock 94 with a hasp 96 extending through aligned apertures 98 in the cover top and bottom panels 22, 24.

Figure 11:
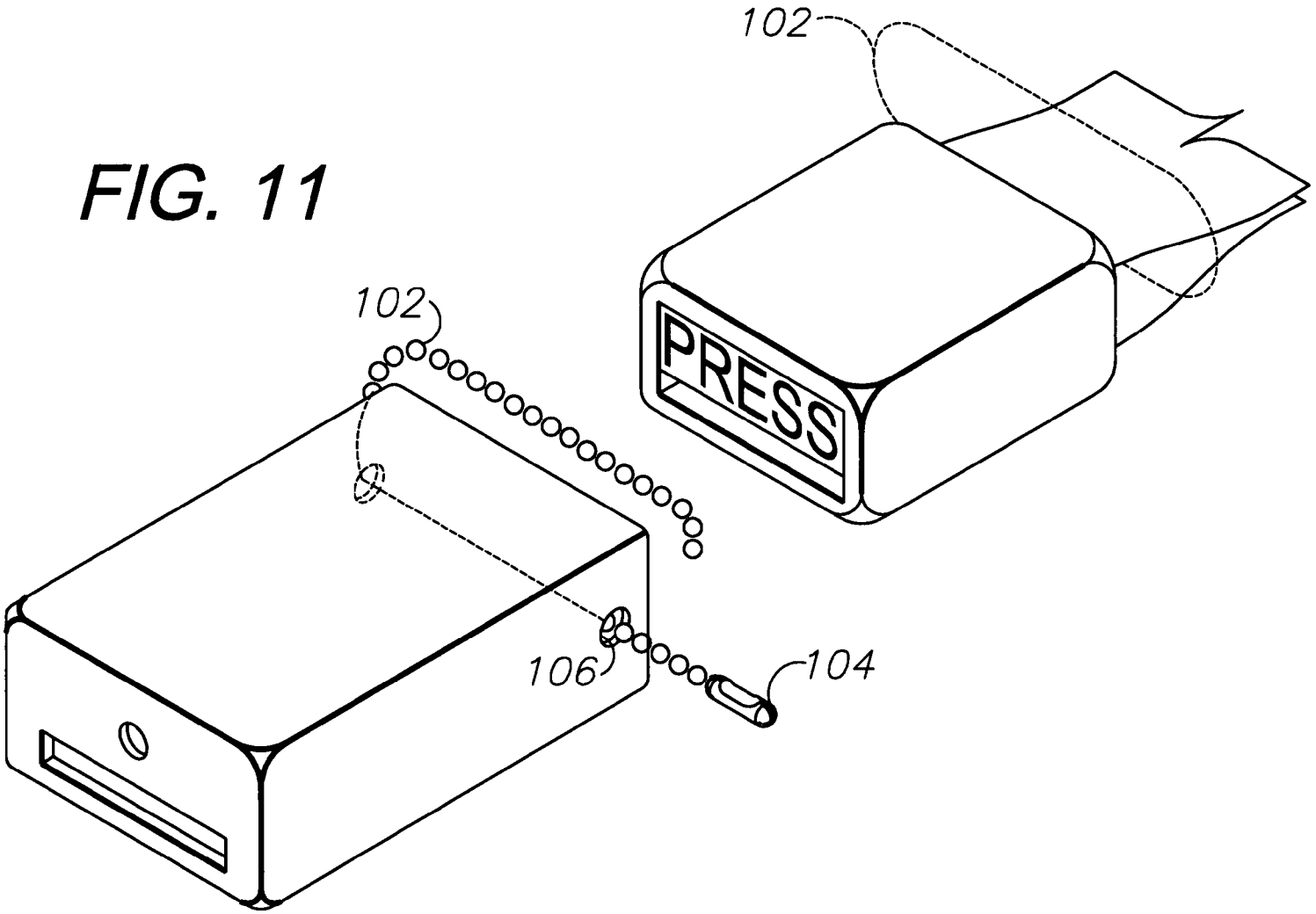
FIG. 11 is a perspective the end of a security cover comprising another aspect of the invention, including a chain retainer.
Figure 12:
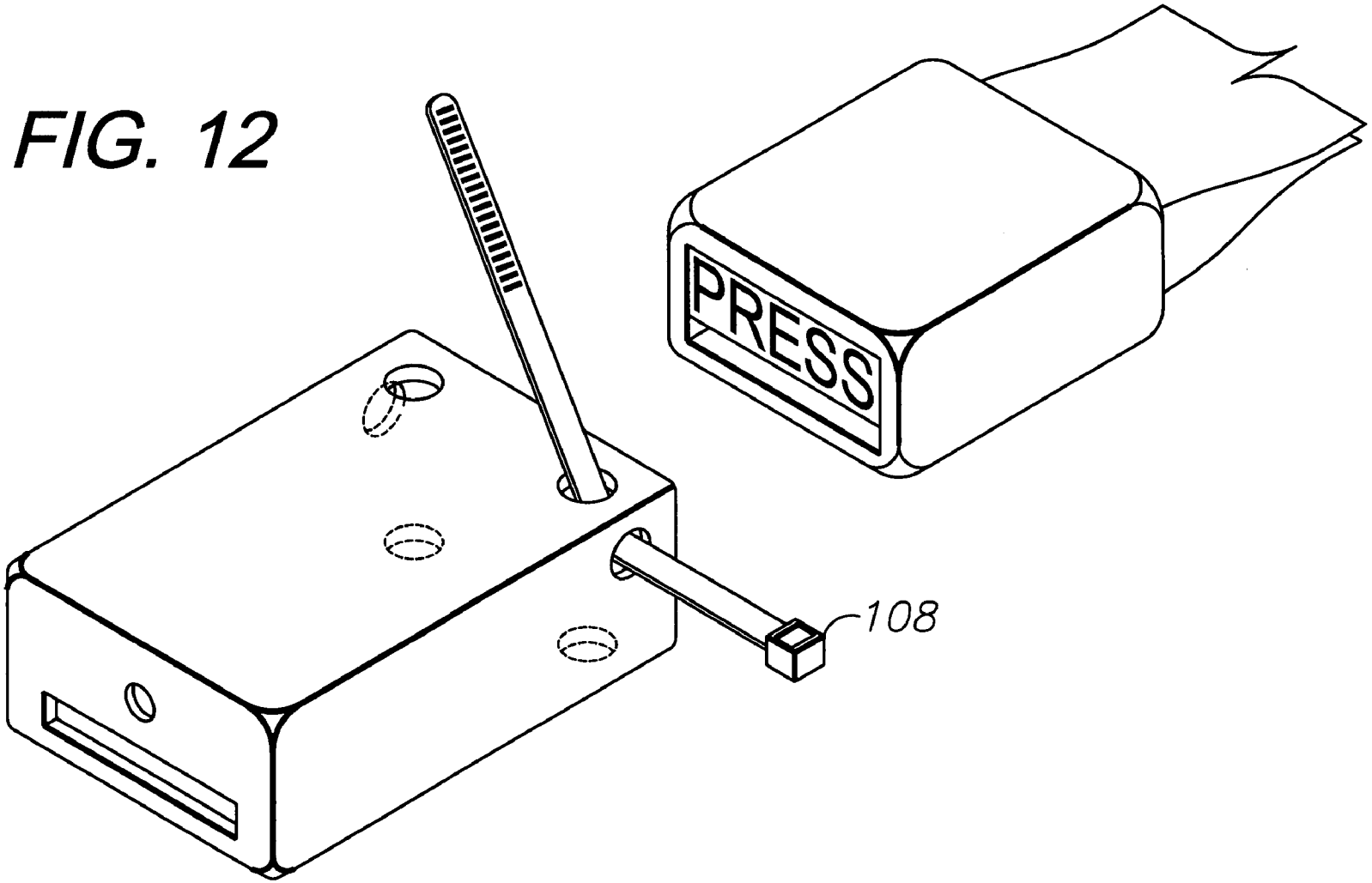
FIG. 12 is a perspective view of a security cover comprising another aspect of the invention, including a cable-tie type retainer.

Fig 11 shows another aspect of the invention including a chain 102 with a connecting link 104 and multiple apertures 106 formed in the cover whereby various combinations of the apertures 106 can receive the chain 102 for securing same to a buckle receiver 6 or belt 8. FIG. 12 shows a similar aspect of the invention with a flexible plastic cable or wire tie 108 in place of the chain 102.

Figure 14:
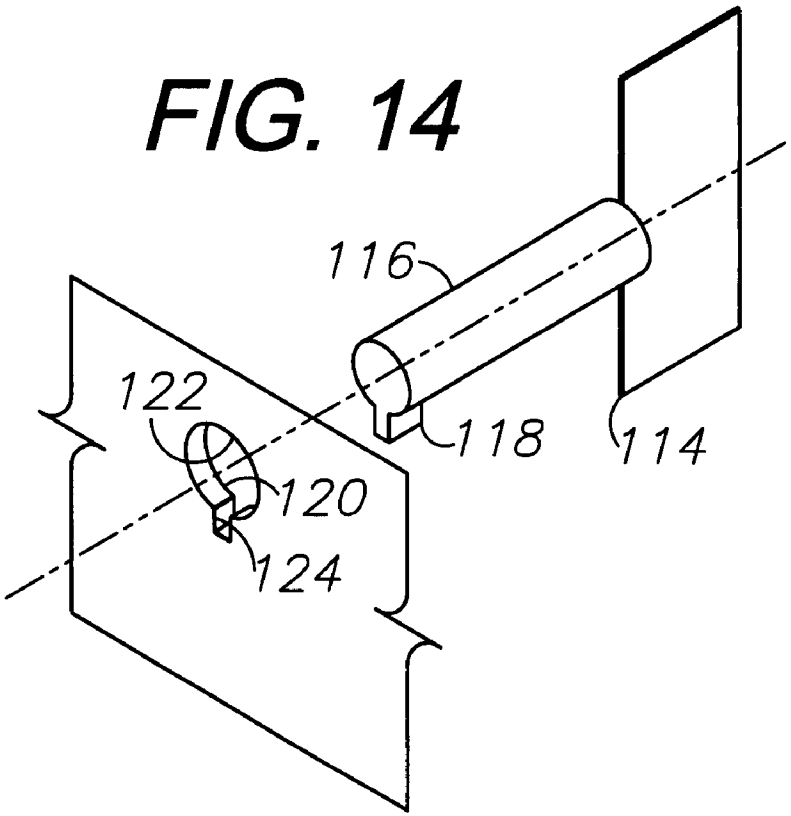
FIG. 14 is a perspective view of a key and a keyhole with alternative configurations.
Figure 13:
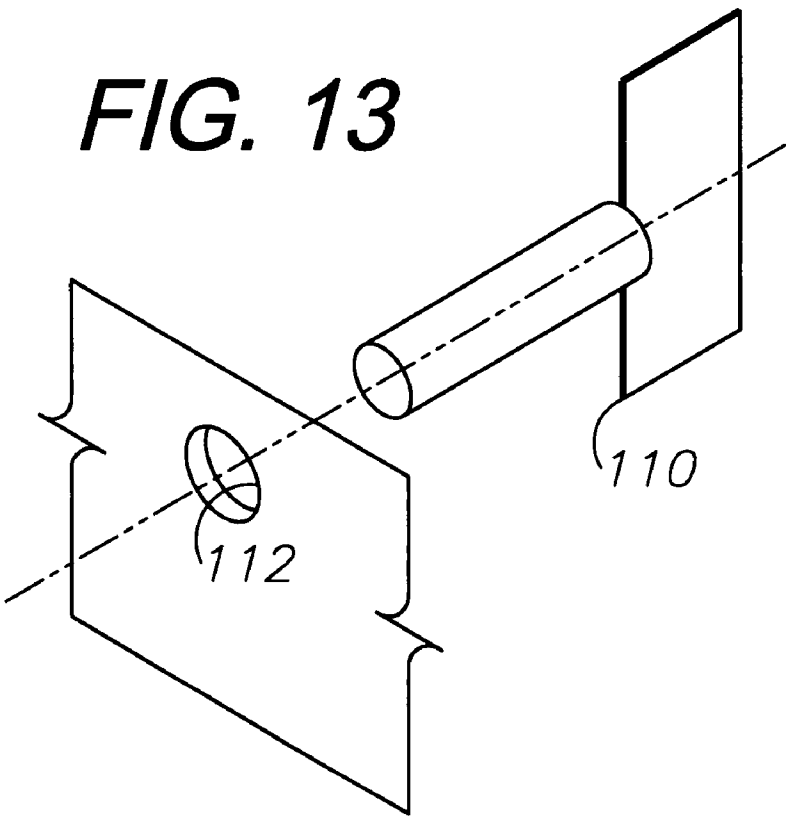
FIG. 13 is a perspective view of a key and a keyhole.

FIG. 13 shows a key 110 with a generally cylindrical configuration and a keyhole 112 with a corresponding round configuration. FIG. 14 shows an alternative key 114 with a generally cylindrical shaft 1 16 and a lever 118 extending radially therefrom. An alternative configuration keyhole 120 includes a round portion 122 adapted to receive the key shaft 116 and a slot 124 adapted to receive the lever 118. The key 114 can comprise the type widely used by law enforcement officials for handcuffs. Other alternative configurations can be utilized for the keys and keyholes, including various geometric shapes.

It is to be understood that the invention can be embodied in various forms, and is not to be limited to the examples discussed above. Other components and configurations can be utilized in the practice of the present invention.

Having thus described the invention, what is claimed as new and desired to be secured by Letters Patent is:

1. A security cover for a belt-type passive restraint system with a buckle including a tab attached to a first belt and a receiver attached to a second belt and selectively engageable with the tab and including a release button for disengaging same, which cover comprises:

a body with a tab end and a buckle end;

said body forming an enclosure adapted to receive the receiver;

said body tab end including a slot for said tab and a keyhole;

said keyhole being generally aligned with said release button with said receiver positioned in said enclosure, and a retainer selectively connected to said cover and to one of said receiver and said second belt, said retainer selectively retaining said receiver within said cover enclosure.

2. The security cover according to claim 1, which includes:

said cover including an aperture in proximity to said buckle end;

said retainer comprising a pin with a proximate end mounting a head and a distal end; and said retainer further comprising a lock mounted on said cover in proximity to its receiver end and adapted for selectively capturing said retainer pin distal end with said buckle receiver in said cover enclosure and said retainer pin in an inserted positioned thereof.

3. The security cover according to claim 2, which includes:

said second belt forming a loop attached to said buckle receiver and receiving said retainer pin in its inserted positioned.

4. The security cover according to claim 3, which includes:

said keyhole comprising a first keyhole; and said cover body having a second keyhole in proximity to said receiver end and located in proximity to said retainer pin lock and adapted for providing access thereto.

5. The security cover according to claim 1 wherein said retainer includes:

a cable with a proximate end fixedly attached to said cover and a distal end; and a retainer cable lock mounted on said cover receiver end and adapted for selectively locking said cable distal end with said cable extending through said belt second portion.

6. The security cover according to claim 1, which includes:

said retainer comprising a bolt and a nut threadably mountable thereon; and a pair of bolt apertures located in the post relation on said cover body in proximity to its receiver end and adapted for selectively receiving said bolt in its inserted positioned.

7. The security cover according to claim 1, wherein said retainer includes: said cover body having a base and an access lid hingedly mounted on the base and movable between a closed position retaining said buckle receiver in said cover enclosure and an open position releasing same.

8. The security cover according to claim 7, which includes: said cover body having a front panel located at said tab end, a back panel located at said receiver end, a top panel, a bottom panel and opposite side panels; said back panel including a notch adapted for selectively receiving said belt first portion with said buckle receiver located in said enclosure; and said access lid including portions of said top and side panels.

9. The security cover according to claim 8, which includes:

said access lid being hingedly mounted on said cover base portion along one of said side panels;

an access lid lock mounted on said cover body and located in proximity to said cover receiver end; and an access lid lock keyhole in said cover in proximity to said access lid lock and adapted for providing access thereto.

10. The security cover according to claim 8, which includes:

said access lid being hingedly mounted on said cover base portion along one of said side panels;

an access lid lock mounted on said cover body and located in proximity to said cover receiver end; and an access lid lock keyhole in said cover in proximity to said access lid lock and adapted for providing access thereto.

11. The security cover according to claim 1, which includes:

said cover body having a front panel located at said tab end, a back panel located at said receiver end, a top panel, a bottom panel and opposite side panels;

said cover including an aligned pair of lock hasp apertures in said side panels and in proximity to the cover receiver end; and said retainer comprising a padlock with a hasp selectively receivable in said hasp apertures.

12. The security cover according to claim 1, which includes:

said cover body having a front panel located at said tab end, a back panel located at said receiver end, a top panel, a bottom panel and opposite side panels;

said cover including an aligned pair of lock hasp apertures in said top and bottom panels and in proximity to the cover receiver end; and said retainer comprising a padlock with a hasp selectively receivable in said hasp apertures.

13. The security cover according to claim 1, which includes:

said cover body having a front panel located at said tab end, a back panel located at said receiver end, a top panel, a bottom panel and opposite side panels;

a pair of aligned apertures in said side panels; and said retainer comprising a chain with a closure link adapted for selectively closing said chain in a continuous configuration; and said chain extending through said aligned apertures and through said belt receiver portion with said retainer in a retaining positioned thereof.

14. The security cover according to claim 1, which includes:

said cover body having a front panel located at said tab end, a back panel located at said receiver end, a top panel, a bottom panel and opposite side panels;

a pair of apertures in one of said side panels and in said top panel in proximity to said body receiver end; and said retainer comprising a flexible locking tie strap with a closure adapted for closing same; and said tie strap extending through said apertures and through said belt receiver portion with said retainer in a retaining positioned thereof.

15. The security cover according to claim 1, which includes:

a key with a generally cylindrical configuration; and said keyhole having a generally round configuration adapted to receive said key.

16. The security cover according to claim 1, which includes:

a key with a generally cylindrical shaft and a lever extending radially therefrom; and said keyhole having a configuration with a circular portion adapted to receive said shaft and a slot adapted to receive said lever.

17. A security cover for a belt-type passive restraint system with a buckle including a tab attached to a first belt and a receiver attached to a second belt and selectively engageable with the tab and including a release button for disengaging same, which cover comprises:

a body with a tab end and a buckle end;

said body forming an enclosure open at said buckle end and adapted to receive the receiver;

said body tab end including a slot for said tab and a keyhole positioned above said slot;

said body including a pair of side panels, a top panel and bottom panel;

a retainer assembly including a retainer pin with a proximate end, an enlarged head mounted on said proximate end and a distal end with a slot;

said body having a retainer pin receiver in one of said side panels, said retainer pin receiver selectively receiving said retainer pin;

said retainer assembly including a retainer pin lock associated with the other said side panel and adapted for capturing the distal end of said retainer pin;

said retainer pin being adapted for extending through or across said belt adjacent to said buckle receiver for retaining said buckle receiver within said security cover enclosure; and said tab end keyhole being generally aligned with said release button with said receiver positioned in said enclosure.

18. The security cover according to claim 17 wherein:

said retainer pin receiver comprises a first retainer pin receiver;

said body includes a second retainer pin receiver located in the other said side panel and transversely aligned with said first retainer can receiver;

said retainer pin includes an aperture in its distal end; and said retainer assembly includes a flexible spring clip selectively receivable in said retainer pin distal end aperture adjacent to said other side panel with said retainer pin extending through said retainer pin receivers whereby said retainer pin is retained in said body adjacent to its receiver end.

19. A security cover for a belt-type passive restraint system with a buckle including a tab attached to a first belt and a receiver attached to a second belt and selectively engageable with the tab and including a release button for disengaging same, which cover comprises:

a body with a tab end and a buckle end;

said body forming an enclosure adapted to receive the receiver;

said body tab end including a slot for said tab and a tab end keyhole positioned above said slot;

said tab end keyhole including a round portion and a slot extending radially from said round portion;

said body including a pair of side panels, a top panel and bottom panel said buckle end including a panel with a belt opening adapted to selectively receive said second belt with said buckle receiver positioned in said cover enclosure;

said body including a lid comprising at least a portion of said a top panel and said side panels;

a hinge mounting said lid on said top panel or a respective side panel;

a lid lock mounted on said body and adapted for locking said lid and a close positioned thereof;

said body including a lid keyhole aligned with said lid lock with said cover and its lock position and adapted for receiving a key for releasing said lid lock cover;

said tab end keyhole being generally aligned with said release button with said receiver positioned in said enclosure; and a key including a generally cylindrical shaft receivable in said keyhole round portion and a lever extending radially from said shaft and receivable in said keyhole slot.

20. A security cover for a belt-type passive restraint system with a buckle including a tab attached to a first belt and a receiver attached to a second belt and selectively engageable with the tab and including a release button for disengaging same, which cover comprises:

a body with a tab end and a buckle end;

said body forming an enclosure adapted to receive the receiver;

said body tab end including a slot for said tab and a keyhole;

said keyhole being generally aligned with and centered with respect to said release button with said receiver positioned in said enclosure;

said tab end keyhole including a round portion and a slot extending radially from said round portion; and a key including a generally cylindrical shaft receivable in said keyhole round portion and a lever extending radially from said shaft and receivable in said keyhole slot, wherein the key pushes the button for releasing the tab from the buckle receiver when inserted through the keyhole.

* * * * *